US010739006B2

(12) United States Patent
Patel et al.

(10) Patent No.: US 10,739,006 B2
(45) Date of Patent: Aug. 11, 2020

(54) FUEL NOZZLE FOR A GAS TURBINE ENGINE

(71) Applicant: General Electric Company, Schenectady, NY (US)

(72) Inventors: Nayan Vinodbhai Patel, Liberty Township, OH (US); Alfred Albert Mancini, Cincinnati, OH (US); Duane Douglas Thomsen, Lebanon, OH (US); Michael Anthony Benjamin, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 580 days.

(21) Appl. No.: 15/459,309

(22) Filed: Mar. 15, 2017

(65) Prior Publication Data

US 2018/0266692 A1 Sep. 20, 2018

(51) Int. Cl.
*F23R 3/34* (2006.01)
*F23R 3/28* (2006.01)

(52) U.S. Cl.
CPC ..... *F23R 3/343* (2013.01); *F23R 3/28* (2013.01); *F23R 2900/00004* (2013.01)

(58) Field of Classification Search
CPC ..... F23R 3/28–286; F23R 3/34–346
See application file for complete search history.

(56) References Cited

U.S. PATENT DOCUMENTS 4,986,068 A 1/1991 Lee et al.
5,243,816 A 9/1993 Huddas
6,804,946 B2 10/2004 Willis et al.
6,898,926 B2 5/2005 Mancini
6,898,938 B2 5/2005 Mancini et al.
6,959,535 B2 11/2005 Mancini et al.
7,036,302 B2 5/2006 Myers, Jr. et al.
8,220,270 B2 7/2012 Bathina et al.
8,443,609 B2 5/2013 Doerr et al.
8,474,266 B2 7/2013 Berry et al.
8,522,554 B2 9/2013 Intile et al.
8,555,645 B2 10/2013 Duncan et al.
8,851,402 B2 10/2014 Dinu et al.
9,453,461 B2 9/2016 Patel et al.
(Continued)

FOREIGN PATENT DOCUMENTS

WO WO2015/122952 A2 8/2015

*Primary Examiner* — Arun Goyal
(74) *Attorney, Agent, or Firm* — Dority & Manning, P.A.

(57) ABSTRACT

A fuel nozzle for a gas turbine engine includes an outer body defining a plurality of openings in an exterior surface. The fuel nozzle also includes a main injection ring disposed at least partially inside the outer body. The main injection ring includes a plurality of fuel posts extending into or through the plurality of openings of the outer body. The plurality of fuel posts include an LP fuel post defining a main fuel orifice, a top surface, and a scarf, the scarf of the LP fuel post extending in the top surface in a first direction relative to the centerline axis away from the main fuel orifice. The plurality of fuel posts also include an HP fuel post defining a main fuel orifice, a top surface, and a scarf, the scarf of the HP fuel post extending in the top surface f in a second direction relative to the centerline axis away from the main fuel orifice, the second direction being at least ninety degrees different than the first direction.

16 Claims, 8 Drawing Sheets

(56) References Cited

U.S. PATENT DOCUMENTS

| | | | | |
|---|---|---|---|---|
| 10,451,282 | B2 * | 10/2019 | Benjamin | F23R 3/286 |
| 2016/0017809 | A1 | 1/2016 | Ott et al. | |
| 2016/0305327 | A1 | 10/2016 | Patel et al. | |

* cited by examiner

FUEL NOZZLE FOR A GAS TURBINE ENGINE

FIELD

The present subject matter relates generally to a fuel nozzle for a gas turbine engine.

BACKGROUND

A gas turbine engine generally includes a fan and a core arranged in flow communication with one another. Additionally, the core of the gas turbine engine generally includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air using one or more fuel nozzles within the combustion section and burned to provide combustion gases. The combustion gases are routed from the combustion section to the turbine section. The flow of combustion gasses through the turbine section drives the turbine section and is then routed through the exhaust section, e.g., to atmosphere.

More specifically, the fuel nozzles function to introduce liquid fuel into an air flow stream such that the liquid fuel may atomize and burn. Additionally, staged fuel nozzles have been developed to operate with relatively high efficiency and operability. In a staged fuel nozzle, fuel may be introduced through two or more discrete stages, with each stage being defined by an individual fuel flow path within the fuel nozzle. For example, at least certain staged fuel nozzles include a pilot stage that may be operable continuously, and a main stage that operates at, e.g., high power levels.

With certain embodiments, the main stage may include an annular main injection ring having a plurality of fuel injection ports which discharge fuel through a round centerbody into a swirling mixer airstream. When the main stage is not in use, it may be beneficial to purge at least a portion of the fuel therein such that the fuel does not increase in temperature and begin to coke. Accordingly, a fuel nozzle with one or more features enabling the main stage of the fuel nozzle to purge at least a portion of the fuel therein would be useful.

BRIEF DESCRIPTION

Aspects and advantages of the invention will be set forth in part in the following description, or may be obvious from the description, or may be learned through practice of the invention.

In one exemplary embodiment of the present disclosure, a fuel nozzle for a gas turbine engine is provided. The fuel nozzle defines a centerline axis and includes an outer body extending generally along the centerline axis and defining an exterior surface, the outer body defining a plurality of openings in the exterior surface. The fuel nozzle also includes a main injection ring disposed at least partially inside the outer body. The main injection ring includes a plurality of fuel posts extending into or through the plurality of openings of the outer body. The plurality of fuel posts include an LP fuel post defining a main fuel orifice, a top surface, and a scarf, the scarf of the LP fuel post extending in the top surface in a first direction relative to the centerline axis away from the main fuel orifice. The plurality of fuel posts also include an HP fuel post defining a main fuel orifice, a top surface, and a scarf, the scarf of the HP fuel post extending in the top surface f in a second direction relative to the centerline axis away from the main fuel orifice, the second direction being at least ninety degrees different than the first direction.

In certain exemplary embodiments the LP fuel post further defines a spray well between the main fuel orifice and the top surface, wherein the scarf of the LP fuel post extends in the top surface from the spray well of the LP fuel post, wherein the HP fuel post also further defines a spray well between the main fuel orifice and the top surface, and wherein the scarf of the HP fuel post also extends in the top surface from the spray well of the HP fuel post.

In certain exemplary embodiments the scarf of the LP fuel post extends in the top surface from the main fuel orifice of the LP fuel post, and wherein the scarf of the HP fuel post also extends in the top surface from the main fuel orifice of the HP fuel post.

In certain exemplary embodiments the second direction is about one hundred and eighty degrees different than the first direction.

In certain exemplary embodiments the LP fuel post is arranged sequentially with the HP fuel post.

In certain exemplary embodiments the plurality of fuel posts further comprises a plurality of LP fuel posts and a plurality of HP fuel posts. For example, in certain exemplary embodiments the plurality of LP fuel posts are arranged with the plurality of HP fuel posts in a sequential and alternating manner. Additionally or alternatively, in certain exemplary embodiments the plurality of LP fuel posts are grouped together and wherein the plurality of HP fuel posts are also grouped together.

In certain exemplary embodiments the scarf defined in the top surface of the HP fuel post is a channel defining a height and a length, and wherein the height is substantially constant along the length.

In certain exemplary embodiments the top surfaces of the LP and HP fuel posts each generally define at least one of a teardrop shape, an ovular shape, or a circular shape.

In certain exemplary embodiments the top surface of the HP fuel post includes a narrow end and a wide end, and wherein the narrow end is positioned forward of the wide end along the second direction.

In certain exemplary embodiments the outer body further defines an airflow direction over the outer body relative to the centerline axis, and wherein the first direction is substantially aligned with the airflow direction defined by the outer body.

In certain exemplary embodiments the main injection ring comprises a main fuel gallery extending generally about the axial centerline and fluidly connecting the plurality of fuel posts.

In certain exemplary embodiments the fuel post further includes a suspension structure connecting the main injection ring to the outer body, the suspension structure configured to permit deflection of the main injection ring relative to the axial centerline.

The fuel nozzle of claim 1, wherein the scarf defined by the LP fuel post defines a height, a length, or both that is different than a height, a length, or both of the scarf defined by the HP fuel post.

In certain exemplary embodiments the scarf defined by the LP fuel post defines a length to height ratio, wherein the scarf defined by the HP fuel post similarly defines a length to height ratio, and wherein the length to height ratio of the scarf defined by the HP fuel post is less than the length to height ratio of the scarf defined by the LP fuel post. For example, in certain exemplary embodiments the length to height ratio of the scarf defined by the HP fuel post is at least about twenty percent less than the length to height ratio of the scarf defined by the LP fuel post.

In another exemplary embodiment of the present disclosure, a fuel nozzle for a gas turbine engine is provided. The fuel nozzle defines a centerline axis and includes an outer body extending generally along the centerline axis and defining an exterior surface. The outer body finds a plurality of openings in the exterior surface. The outer body further defines an airflow direction over the outer body relative to the centerline axis. The fuel nozzle also includes a main injection ring disposed at least partially inside the outer body and including a fuel post and a main fuel gallery. The main fuel gallery extends generally about the axial centerline and the fuel post extends away from the fuel post into or through one of the plurality of openings of the outer body. The fuel post defines a main fuel orifice, a top surface, and a scarf, the scarf extending in the top surface in a second direction relative to the centerline axis away from the main fuel orifice, the second direction being at least ninety degrees different than the airflow direction.

In certain exemplary embodiments the fuel post of the main injection ring is an HP fuel post, wherein the main injection ring further comprises an LP fuel post, wherein the LP fuel post defines a main fuel orifice, a top surface, and a scarf, wherein the scarf of the LP fuel post extends in the top surface in a first direction relative to the centerline axis away from the main fuel orifice, and wherein the first direction is substantially aligned with the airflow direction defined by the outer body.

In certain exemplary embodiments the LP fuel post further defines a spray well between the main fuel orifice and the top surface, wherein the scarf of the LP fuel post extends in the top surface from the spray well of the LP fuel post.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
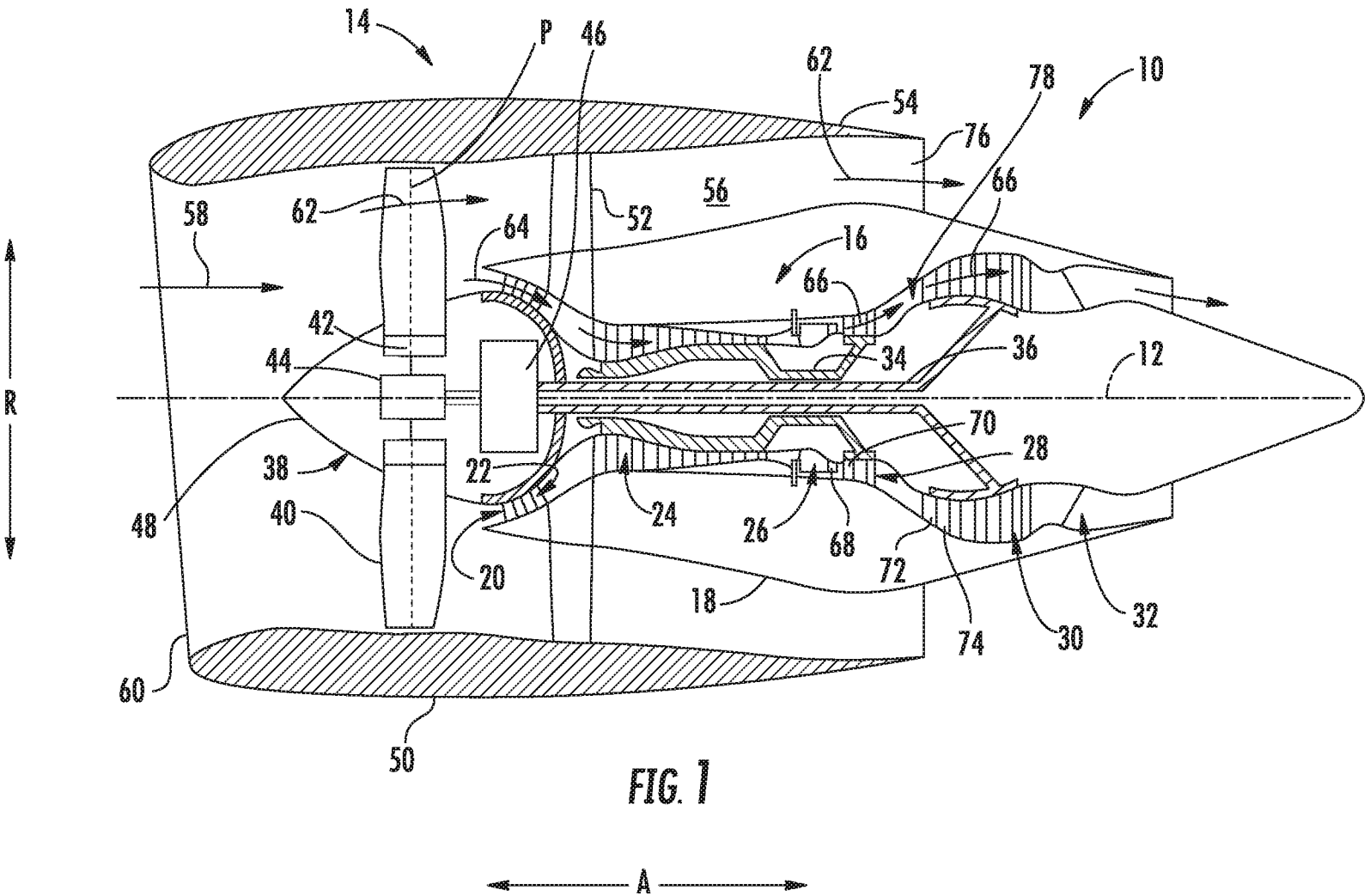
FIG. 1 is a schematic cross-sectional view of an exemplary gas turbine engine according to various embodiments of the present subject matter.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components.

The terms "forward" and "aft" refer to relative positions within a gas turbine engine, with forward referring to a position closer to an engine inlet and aft referring to a position closer to an engine nozzle or exhaust.

The terms "upstream" and "downstream" refer to the relative direction with respect to fluid flow in a fluid pathway. For example, "upstream" refers to the direction from which the fluid flows, and "downstream" refers to the direction to which the fluid flows.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems.

Here and throughout the specification and claims, range limitations may be combined and interchanged, such that ranges identified include all the sub-ranges contained therein unless context or language indicates otherwise.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline 12 provided for reference), a radial direction R, and a circumferential direction (i.e., a direction extending about the axial direction A; not depicted). In general, the turbofan 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22. The compressor section, combustion section 26, turbine section, and jet exhaust nozzle section 32 together define a core air flowpath 37 through the core turbine engine 16.

For the embodiment depicted, the fan section 14 includes a variable pitch fan 38 having a plurality of fan blades 40 coupled to a disk 42 in a spaced apart manner. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan blades 40, disk 42, and actuation member 44 are together rotatable about the longitudinal axis 12 by LP shaft 36 across a power gear box 46. The power gear box 46 includes a plurality of gears for stepping down the rotational speed of the LP shaft 36 to a more efficient rotational fan speed.

Referring still to the exemplary embodiment of FIG. 1, the disk 42 is covered by rotatable front nacelle 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that the nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass airflow passage 56 therebetween.

During operation of the turbofan engine 10, a volume of air 58 enters the turbofan 10 through an associated inlet 60 of the nacelle 50 and/or fan section 14. As the volume of air 58 passes across the fan blades 40, a first portion of the air 58 as indicated by arrows 62 is directed or routed into the bypass airflow passage 56 and a second portion of the air 58 as indicated by arrow 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel provided through one or more fuel nozzles and burned to provide combustion gases 66.

The combustion gases 66 are routed from the combustion section 26, through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

It should be appreciated, however, that the exemplary turbofan engine 10 depicted in FIG. 1 is by way of example only, and that in other exemplary embodiments, the turbofan engine 10 may have any other suitable configuration. Additionally, or alternatively, aspects of the present disclosure may be utilized with any other suitable aeronautical gas turbine engine, such as a turboshaft engine, turboprop engine, turbojet engine, etc. Moreover, aspects of the present disclosure may further be utilized with any other land-based gas turbine engine, such as a power generation gas turbine engine, or any aeroderivative gas turbine engine, such as a nautical gas turbine engine.

Figure 2:
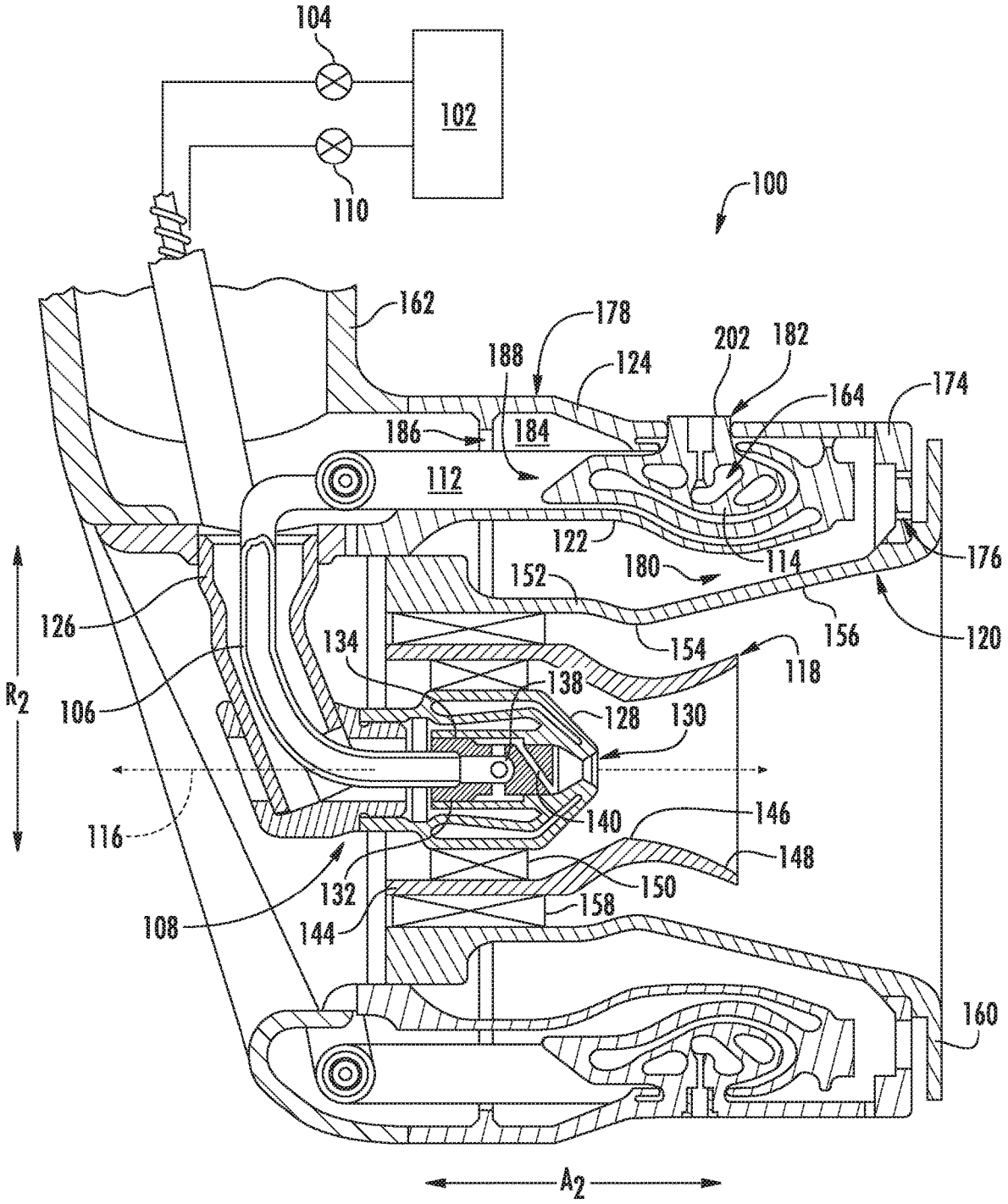
FIG. 2 is a schematic, cross-sectional view of a fuel nozzle in accordance with an exemplary embodiment of the present disclosure.

Referring now to FIG. 2, a side, cross-sectional view is provided of a fuel nozzle 100 in accordance with an exemplary embodiment of the present disclosure. The exemplary fuel nozzle 100 depicted in FIG. 2 may be included within a combustor assembly of the exemplary combustion section 26 described above with reference to FIG. 1. Alternatively, however, the exemplary fuel nozzle 100 of FIG. 2 may instead be included within a combustor assembly of a combustion section 26 of any other suitable gas turbine engine.

The exemplary fuel nozzle 100 of FIG. 2 may be configured to inject liquid hydrocarbon fuel into an airflow stream of the combustor assembly with which it is included. The fuel nozzle 100 is of a "staged" type, meaning it is operable to selectively inject fuel through two or more discrete stages, each stage being defined by individual fuel flowpaths within the fuel nozzle 100. A fuel flowrate may also be variable within each of the stages.

The fuel nozzle 100 is connected to a fuel system 102 operable to supply a flow of liquid fuel at varying flowrates according to operational need. The fuel system 102 supplies fuel to a pilot control valve 104 which is coupled to a pilot fuel conduit 106, which in turn supplies fuel to a pilot 108 of the fuel nozzle 100. The fuel system 102 also supplies fuel to a main valve 110 which is coupled to a main fuel conduit 112, which in turn supplies a main injection ring 114 of the fuel nozzle 100.

The fuel nozzle 100 generally defines an axial direction A2 extending along a centerline axis 116, a radial direction R2, and a circumferential direction C2. The centerline axis 116 of the fuel nozzle 100 may generally be parallel to a longitudinal centerline of a gas turbine engine within which it is installed (see, e.g., longitudinal centerline 12 of turbofan engine 10 of FIG. 1). Starting from the centerline axis 116 and proceeding outwardly along the radial direction R2, the illustrated fuel nozzle 100 includes: the pilot 108, a splitter 118, a venturi 120, an inner body 122, the main injection ring 114, and an outer body 124. Each of these structures will be described in more detail below.

The pilot 108 is disposed at an upstream end of the fuel nozzle 100, aligned with the centerline axis 116. The illustrated pilot 108 includes a generally cylindrical, axially-elongated, pilot centerbody 128. An upstream end of the pilot centerbody 128 is connected to the fairing 126. The downstream end of the pilot centerbody 128 includes a converging-diverging discharge orifice 130 with a conical exit.

A metering plug 132 is disposed within a central bore 134 of the pilot centerbody 128. The metering plug 132 communicates with the pilot fuel conduit. The metering plug 132 includes transfer holes 136 that flow fuel to a feed annulus 138 defined between the metering plug 132 and the central bore 134, and also includes an array of angled spray holes 140 arranged to receive fuel from the feed annulus 138 and flow it towards the discharge orifice 130 in a swirling pattern, with a tangential velocity component.

The annular splitter 118 surrounds the pilot injector 108. It includes, in axial sequence: a generally cylindrical upstream section 144, a throat 146 of minimum diameter, and a downstream diverging section 148. Additionally, an inner air swirler comprises a radial array of inner swirl vanes 150 which extend between the pilot centerbody 128 and the upstream section 144 of the splitter 118. The inner swirl vanes 150 are shaped and oriented to induce a swirl into air flow passing through the inner air swirler.

The annular venturi 120 surrounds the splitter 118. It includes, in axial sequence: a generally cylindrical upstream section 152, a throat 154 of minimum diameter, and a downstream diverging section 156. A radial array of outer swirl vanes 158, defining an outer air swirler, extends between the splitter 118 and the venturi 120. The outer swirl vanes 158, splitter 118, and inner swirl vanes 150 physically support the pilot 108. The outer swirl vanes 158 are shaped and oriented to induce a swirl into air flow passing through the outer air swirler. The bore of the venturi 120 defines a flowpath for a pilot air flow, generally designated "P", through the fuel nozzle 100. A heat shield 160 in the form of an annular, radially-extending plate may be disposed at an aft end of the diverging section 156. A thermal barrier coating (TBC) (not shown) of a known type may be applied on the surface of the heat shield 160 and/or the diverging section 156.

The inner body 122 may be connected to the fairing 126 and serves as part of a mechanical connection between the main injection ring 114 and stationary mounting structure such as a fuel nozzle stem, a portion of which is shown as item 162.

The main injection ring 114 is for the embodiment depicted annular in form and surrounds the inner body 122. More specifically, the main injection ring 114 extends generally about the centerline axis 116 (i.e., in a circumferential direction C2). It is connected to the inner body 122 and to the outer body 124 by a suspension structure 188 which is described in more detail below with reference to FIG. 3.

Figure 3:
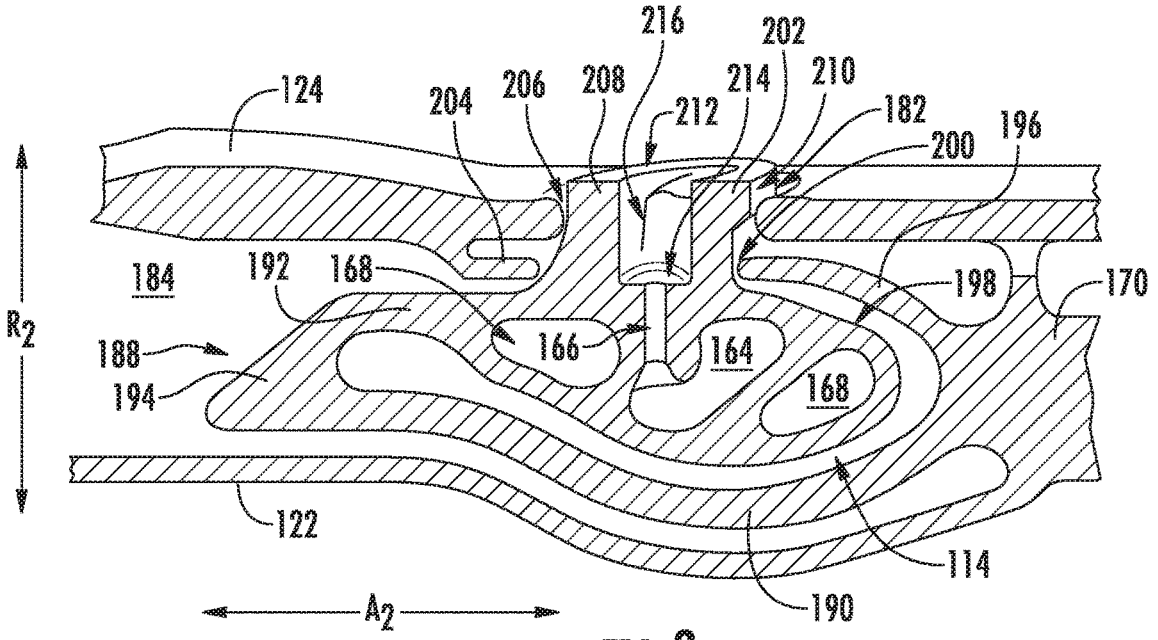
FIG. 3 is a close-up, cross-sectional view of a section of the exemplary fuel nozzle of FIG. 2.

Referring now also to FIG. 3, providing a close-up view of the exemplary main injection ring 114, the main injection ring 114 includes a main fuel gallery 164 (sometimes also referred to as a main fuel tube). The main fuel gallery 164 is coupled to and supplied with fuel by the main fuel conduit 112 (see FIG. 2). A radial array of main fuel orifices 166 formed in the main injection ring 114 communicate with the main fuel gallery 164. During engine operation, fuel is discharged through the main fuel orifices 166. Running through the main injection ring 114 closely adjacent to the main fuel gallery 164 are one or more pilot fuel galleries 168. During engine operation, fuel may constantly circulate through the pilot fuel galleries 168 to cool the main injection ring 114 and prevent coking of the main fuel gallery 164 and the main fuel orifices 166.

The outer body 124 is generally annular in shape for the embodiment depicted and generally defines the outer extent of the fuel nozzle 100. Accordingly, the main injection ring 114 is disposed at least partially inside the outer body 124, or rather is disposed substantially inside the outer body 124, as is the venturi 120 and the pilot 108. In the illustrated example, an aft end of the inner body 122 is connected to the outer body 124 by a radially-extending flange 170. A forward end of the outer body 124 is joined to the stem 162 when assembled (see FIG. 2). An aft end of the outer body 124 may include an annular, radially-extending baffle 174 incorporating cooling holes 176 directed at the heat shield 160. Extending between the forward and aft ends is a generally cylindrical exterior surface 178. In operation, the exterior surface 178 defines an airflow direction in which a mixer airflow, generally designated "M", and flows over the exterior surface 178. Accordingly, as will be described in greater detail below, the mixer airflow generally swirls around the exterior surface 178 of the outer body 124 along the mixer airflow direction M.

The exemplary outer body 124 of FIG. 2 additionally defines a secondary flowpath 180, in cooperation with the venturi 120 and the inner body 122. Air passing through this secondary flowpath 180 is discharged through the cooling holes 176.

Moreover, referring still to FIGS. 2 and 3, the outer body 124 additionally defines a plurality of openings 182 in the exterior surface 178 of the outer body 124. Each of the main fuel orifices 166 is aligned with one of the openings 182. Additionally, for the embodiment of FIGS. 2 and 3, the plurality of openings 182 are arranged in an annular array, spaced substantially evenly along the circumferential direction C2 of the fuel nozzle 100. As is described below, fuel posts 202 extend into or through these openings 182. Notably, the fuel posts 202 at least partially define the main fuel orifices 166 extending from the main fuel gallery 164. For the embodiment depicted, the main fuel orifices 166 define a substantially constant diameter along a length thereof.

The outer body 124 and the inner body 122 cooperate to define an annular tertiary space or void 184 protected from the surrounding, external air flow. The main injection ring 114 is contained in this void 184. Within the fuel nozzle 100, a flowpath is provided for the tip air stream to communicate with and supply the void 184 a minimal flow needed to maintain a small pressure margin above the external pressure at locations near the openings 182. In the illustrated example, this flow is provided by a relatively small supply slots 186.

The fuel nozzle 100 and its constituent components may be constructed from one or more metallic alloys. Nonlimiting examples of suitable alloys include nickel and cobalt-based alloys.

All or part of the fuel nozzle 100 or portions thereof may be part of a single unitary, one-piece, or monolithic component, and may be manufactured using a manufacturing process which involves layer-by-layer construction or additive fabrication (as opposed to material removal as with conventional machining processes). Such processes may be referred to as "rapid manufacturing processes" and/or "additive manufacturing processes," with the term "additive manufacturing process" being used herein to refer generally to such processes. Additive manufacturing processes include, but are not limited to: Direct Metal Laser Melting (DMLM), Laser Net Shape Manufacturing (LNSM), electron beam sintering, Selective Laser Sintering (SLS), 3D printing, such as by inkjets and laserjets, Sterolithography (SLA), Electron Beam Melting (EBM), Laser Engineered Net Shaping (LENS), and Direct Metal Deposition (DMD).

The main injection ring 114 is attached to the inner body 122 and to the outer body 124 by a suspension structure 188. The suspension structure 188 includes an annular inner arm 190 extending forward from the flange 170 generally along the axial direction A2. The inner arm 190 passes radially inboard of the main injection ring 114. In section view, the inner arm 190 is curved convex-inward, and is spaced-away from and generally parallels the convex curvature of an inner surface 148 of the main injection ring 114. An annular outer arm 192 extends axially forward from the main injection ring 114. A U-bend 194 interconnects the inner and outer arms 190, 192 at a location forward of the main injection ring 114 along the axial direction A2. A baffle 196 extends forward from the flange 170 also generally along the axial direction A2. The baffle 196 passes radially outboard of the main injection ring 114, between the main injection ring 114 and the outer body 124. In section view the baffle 196 is curved convex-outward, and is spaced-away from and generally parallels the convex curvature of an outer surface 198 of the main injection ring 114. The baffle 196 includes an opening 200 through which a fuel post 202 (described in greater detail below) passes, and a forward end 204 of the baffle is connected to the outer body 124 forward of the opening 200.

The suspension structure 188 is effective to substantially rigidly locate the position of the main injection ring 114 in axial and circumferential directions A2, C2 while permitting controlled deflection in a radial direction R2. This is accomplished by the size, shape, and orientation of the elements of the suspension structure 188. In particular, the inner and outer arms 190, 192 and the U-bend 194 are configured to act as a spring element in the radial direction R2. In effect, the main injection ring 114 substantially has one degree of freedom of movement ("1-DOF").

It should be appreciated, however, that the fuel nozzle 100 described above is by way of example only, and that in other exemplary embodiments the fuel nozzle 100 may have any other suitable configuration, and may be formed in any other suitable manner. For example, in other exemplary embodiments the main injection ring 114 may instead be mounted to the outer body 124 in any other suitable manner.

Referring still to FIGS. 2 and 3, the main injection ring 114, main fuel orifices 166, and openings 182 may be configured to provide a controlled secondary purge air path and an air assist at the main fuel orifices 166 through perimeter gaps 206 defined around the fuel posts 202. The openings 182 are oriented in a radial direction R2 relative to the centerline axis 116, and each fuel post 202 is aligned with one of the openings 182 and is positioned to define the perimeter gap 206 in cooperation with the associated opening 182. These small controlled gaps 206 around the fuel posts 202 permit minimal purge air to flow through to protect internal tip space or void 96 from fuel ingress.

During engine operation, the outer body 124 is exposed to a flow of high-temperature air and therefore experiences relatively significant thermal expansion and contraction, while the main injection ring 114 is constantly cooled by a flow of liquid fuel and remains relative stable. The effect of the suspension structure 188 is to permit thermal growth of the outer body 124 relative to the main injection ring 114 and centerline axis 116 while maintaining a size of perimeter gaps 206 described above, thereby maintaining the effectiveness of the purge flow.

Additionally, as briefly mentioned above, the main injection ring 114 includes a plurality of raised fuel posts 202 extending outwardly along the radial direction R2 from the main fuel gallery 164 of the main injection ring 114 into or through the plurality of openings 182 of the outer body 124. The fuel posts 202 include a perimeter wall 208 defining a lateral surface 210. Additionally, the fuel posts 202 define a distal, top surface 212, a radially-facing floor 214 recessed from the top surface 212, and a spray well 216 therebetween. The spray well 216 is fluidly connected with a respective main fuel orifice 166 to receive a flow of fuel therefrom. Additionally, as is indicated the main fuel gallery 164 extends generally about the centerline axis 116 (e.g., in a circumferential direction C2) fluidly connecting the array of fuel posts 202, or more particularly, fluidly connecting with each of the main fuel orifices 166 and the spray wells 216 of the respective fuel posts 202. Accordingly, it will be appreciated that each of the main fuel orifices 166 extends through the floor 214 of the respective fuel post 202 to fluidly connect with the spray well 216 of the respective fuel post 202 to the respective main fuel orifice 166.

Figure 4:
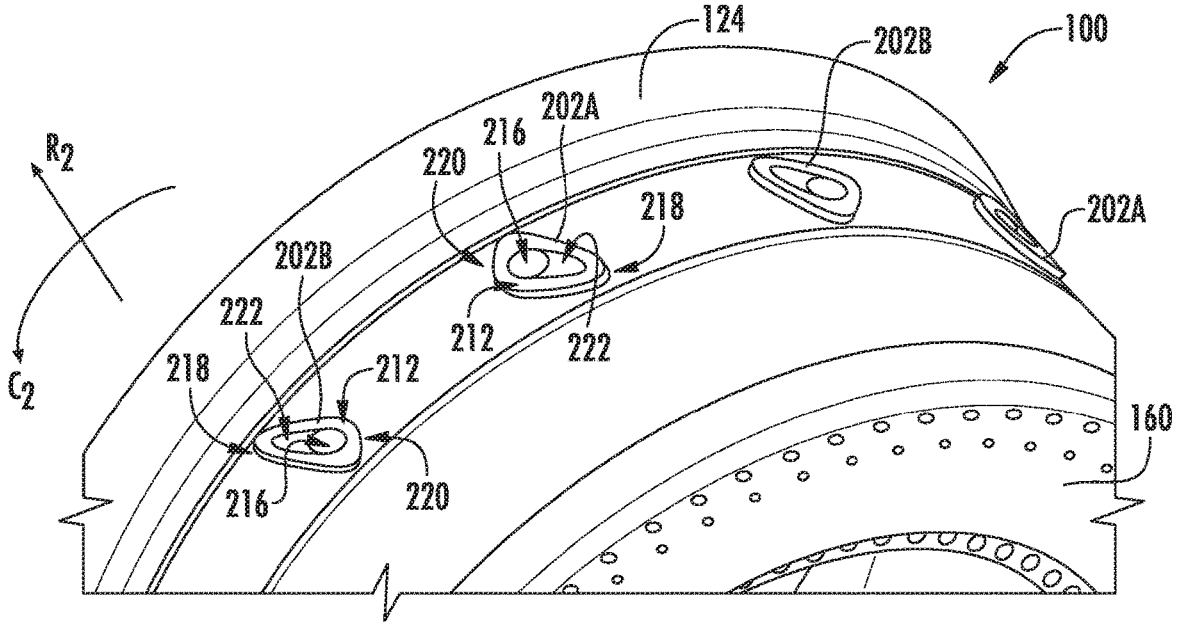
FIG. 4 is a perspective view of a section of the exemplary fuel nozzle of FIG. 2.
Figure 5:
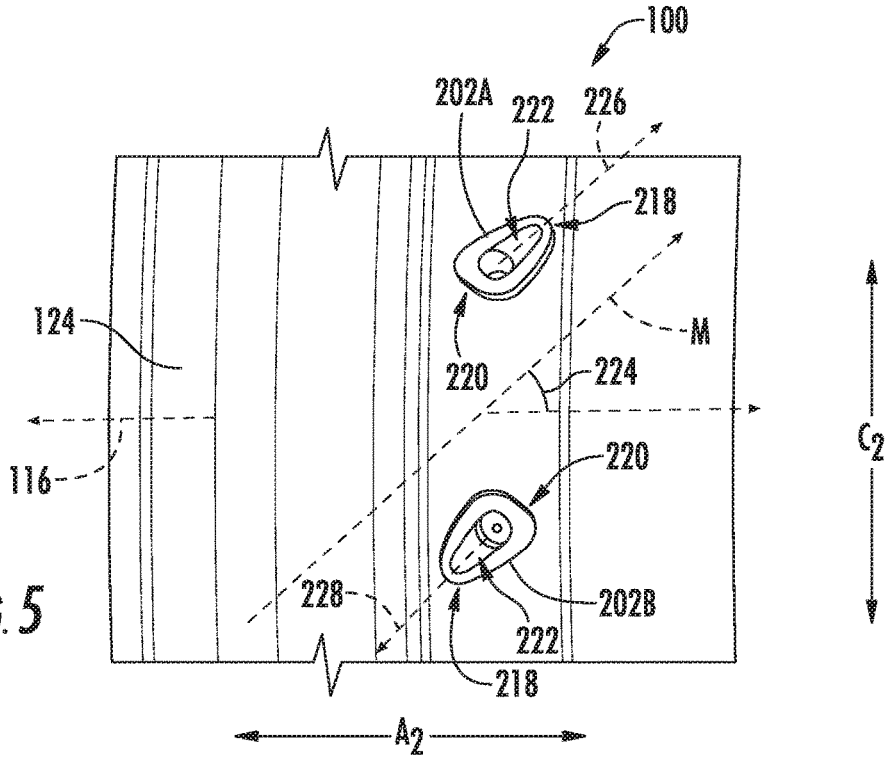
FIG. 5 is a plan view of a section of the exemplary fuel nozzle of FIG. 2.

Referring now to FIGS. 4 and 5, additional views of a portion of the exemplary fuel nozzle 100 of FIGS. 2 and 3 are provided. FIG. 4 provides a perspective view of the exemplary fuel nozzle 100, and FIG. 5 provides a top, plan view of a portion of the exemplary fuel nozzle 100.

As is depicted, the openings 182 define a shape substantially similar to a shape of the top surface 212 of the respective fuel post 202. Additionally, for the embodiment depicted, the top surfaces 212 of the plurality of fuel posts 202 each generally define at least one of a teardrop shape, an ovular shape, a circular shape, or an elliptical shape. More specifically, in the example illustrated the top surfaces 212 of the plurality of fuel posts 202 are each "teardrop-shaped," having two convex-curved ends, with one end having a greater width than the other end (e.g., a greater maximum radius of curvature). Accordingly, the top surface 212 of each of the fuel posts 202 includes a narrow end 218 (i.e., the end with the lesser width) and a wide end 220 (i.e., the end with the greater width).

The elongated shape of the fuel posts 202 provides surface area so that the top end 212 of one or more of the fuel posts 202 can be configured to incorporate a ramp-shaped "scarf" 222. The scarfs 222 can be arranged to generate local static pressure differences between other main fuel orifices 166 (e.g., adjacent main fuel orifices 166). These local static pressure differences between main fuel orifices 166 may be used to purge stagnant main fuel from the main injection ring 114 during periods of pilot-only operation as to avoid main circuit coking.

The orientation of the scarf 222 determines the static air pressure present at the associated main fuel orifice 166 during engine operation. The mixer air flowing in the airflow direction M defined by the outer body 124 exhibits "swirl," that is, its velocity has both axial and circumferential components relative to the centerline axis 116. More specifically, for the exemplary embodiment depicted, the airflow direction M defines an angle 224 with the centerline axis 116 greater than zero degrees and less than about seventy-five degrees. More specifically, for the exemplary embodiment depicted, the angle 224 between the airflow direction M and the centerline axis 116 is between about fifteen degrees and about sixty degrees, such as between about thirty degrees and about forty-five degrees. Notably, however, in other exemplary embodiments, the mixer air may flow/swirl in the other direction, such that the angle 224 defined between the airflow direction M and the centerline axis 116 is the reverse of the angles defined above (i.e., the negative of). Alternatively, in still other embodiments, the mixer air may define an angle 224 with the centerline axis 116 substantially equal to zero, such that the mixer air flows generally along the centerline axis 116.

To achieve the purge function mentioned above, the spray wells 216 may be arranged such that different ones of the main fuel orifices 166 are exposed to different static pressures during engine operation. For example, the exemplary fuel nozzle 100 depicted, and more specifically, the exemplary main injection ring 114 depicted includes an LP fuel post 202A, as well as an HP fuel post 202B. The LP fuel post 202A is generally configured to generate a "low static pressure" (i.e., a reduced static pressure relative to a prevailing static pressure in the mixer airflow) and the HP fuel post 202B is generally configured to generate a "high static pressure" (i.e., an increased static pressure relative to a prevailing static pressure in the mixer airflow). Each of the LP fuel post 202A and the HP fuel post 202B defines a spray well 216, a top surface 212, and a scarf 222. The scarf 222 of the LP fuel post 202A extends in the top surface 212 from the spray well 216 in a first direction 226 relative to the centerline axis 116. By contrast, the scarf 222 of the HP fuel post 202B extends in the top surface 212 from the spray well 216 in a second direction 228 relative to the centerline axis 116. The second direction 228 is at least about ninety degrees different than the first direction 226, and the first direction 226 is substantially aligned with the airflow direction M defined by the outer body 124. More specifically, for the embodiment depicted, the second direction 228 is about one hundred eighty degrees different than the first direction 226, such that the scarf 222 of the HP fuel post 202B extends upstream with respect to the airflow direction M.

Accordingly, the scarf 222 of the LP fuel post 202A may generally be referred to as a "downstream" scarf, while the scarf 222 of the HP fuel post 202B may generally be referred to as an "upstream" scarf. Additionally, as discussed, the top surfaces 212 of the LP and HP fuel posts 202A, 202B each generally define a teardrop shape including a narrow end 218 and a wide end 220. For the top surface 212 of the HP fuel post 202B, the narrow end 218 is positioned forward of the wide end 220 along the second direction 228 (i.e., upstream relative to the airflow direction M), and similarly, for the LP fuel post 202A, the narrow end 218 is positioned forward of the wide end 220 along the first direction 226 (i.e., downstream relative to the airflow direction M). Notably, however, in other exemplary embodiments, the scarf 202 may have any other suitable shape, and/or the HP fuel post 202B may be oriented in any other suitable manner.

For the embodiment depicted, the LP fuel post 202A is arranged sequentially with the HP fuel post 202B. More particularly, for the exemplary fuel nozzle 100 depicted, the array of fuel posts 202 further includes a plurality of LP fuel posts 202A and a plurality of HP fuel post 202B. Each of the plurality of LP fuel posts 202A are, for the embodiment depicted, configured in substantially the same manner as one another, and further, each of the plurality of HP fuel posts 202B are also configured in substantially the same manner as one another. Referring particularly to the embodiment of FIG. 4, the plurality of LP fuel posts 202A are arranged with the plurality of HP fuel posts 202B in a sequential and alternating manner (i.e., arranged in the following pattern: LP fuel post 202A, HP fuel post 202B, LP fuel post 202A, HP fuel post 202B, etc.)

Figure 6:
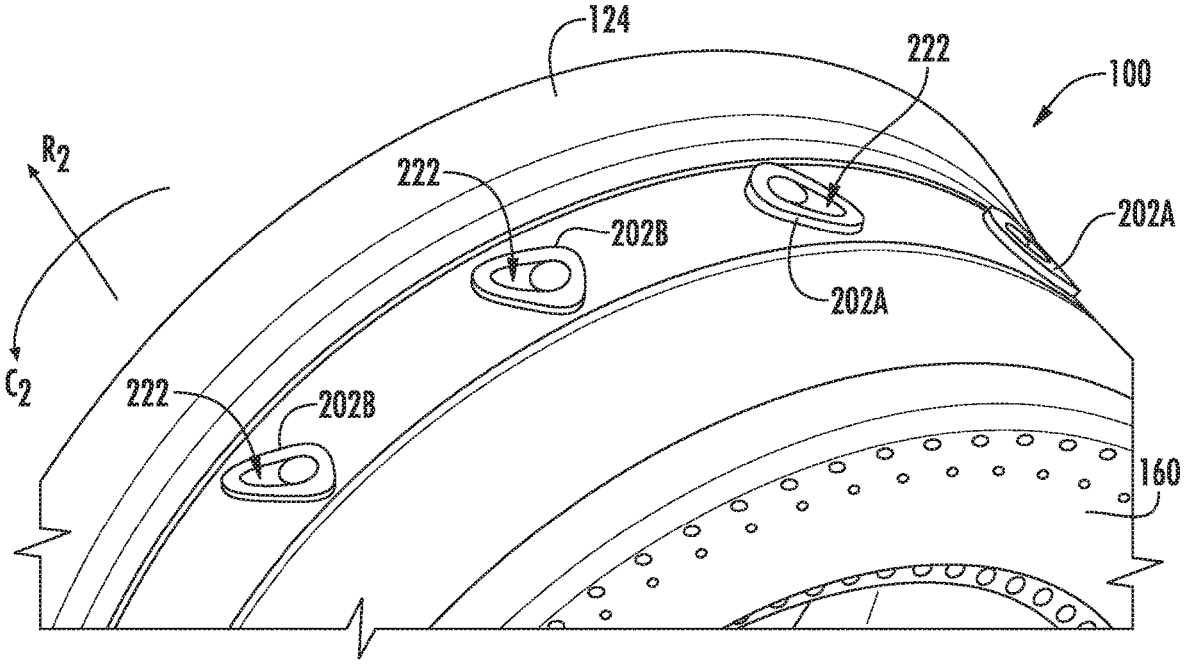
FIG. 6 is a perspective view of a section of a fuel nozzle in accordance with another exemplary embodiment of the present disclosure.

It should be appreciated, however, that in other exemplary embodiments, the plurality of LP fuel posts 202A and HP fuel posts will 202B may instead be arranged in any other suitable manner. For example, referring briefly now to FIG. 6, providing a perspective view of a section of a fuel nozzle 100 in accordance with another exemplary embodiment of the present disclosure, the plurality of LP fuel posts 202A are grouped together and the plurality of HP fuel posts 202B are also grouped together. More specifically, for the exemplary embodiment of FIG. 6, each of the plurality of LP fuel posts 202A are arranged sequentially and each of the plurality of HP fuel posts 202B are also arranged sequentially, separate from the LP fuel post 202A. However, in still other exemplary embodiments, the plurality of LP fuel posts 202A and HP fuel posts 202B may be arranged in any other suitable manner. Additionally, for the exemplary embodiment depicted, the main injection ring 114 includes an equal number of LP fuel posts 202A and HP fuel posts 202B. However, in other exemplary embodiments, the main injection ring 114 may have any other suitable ratio of LP fuel posts 202A to HP fuel posts 202B. Further, in still other exemplary embodiments, the main injection ring 114 may include one or more fuel posts 202 without a scarf 222 defined in the top surface.

Figure 7:
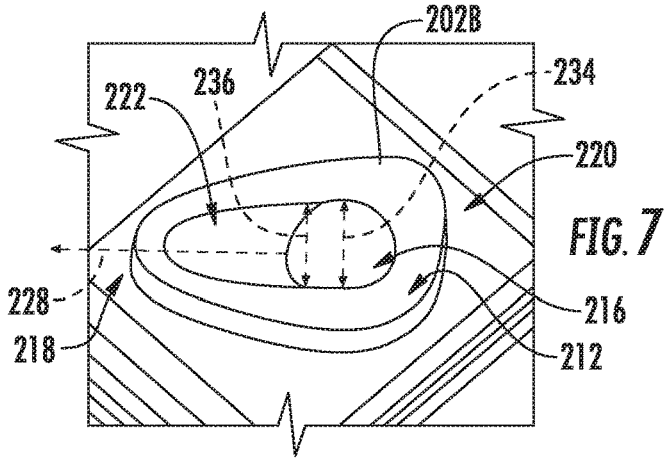
FIG. 7 is a perspective view of a fuel post of a fuel nozzle in accordance with an exemplary embodiment of the present disclosure.
Figure 8:
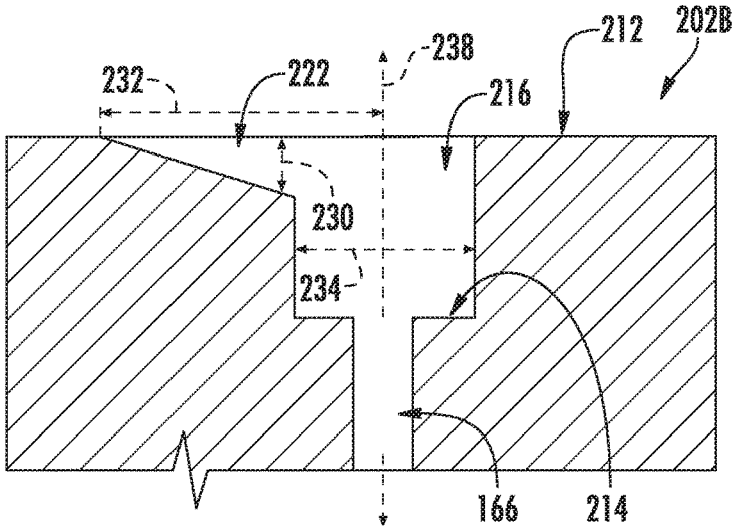
FIG. 8 is a side, cross-sectional view of the exemplary fuel post of FIG. 7.

Referring now to FIGS. 7 and 8, a fuel post 202 including a scarf 222 in accordance with an exemplary embodiment of the present disclosure is provided. The exemplary fuel post 202 and scarf 222 of FIGS. 7 and 8 is described as an HP fuel post 202B and scarf 222 (it being appreciated, however, that in other embodiments the fuel post 202 and scarf 222 depicted may instead be an LP fuel post 202A and scarf 222).

As is depicted, the scarf 222 generally defines a height 230 and a length 232. The scarf 222 defines a maximum height 230 at the spray well 216. The length 232 of the scarf 222 extends in a direction parallel to the second direction 228, extending gradually (with, for the embodiment depicted, a constant slope) to a minimum height 230 at a distal end of zero (i.e., flush with the top surface 212; FIG. 7). Additionally, the exemplary spray well 216 defines a maximum width 234 and the scarf 222 similarly defines maximum width 236 (e.g., in a plane parallel to the top surface 212). For the embodiment depicted, the maximum width 236 of the scarf 222 is substantially equal to the maximum width 234 of the exemplary spray well 216.

Referring particularly to FIG. 8, the length 232 of the scarf 222 refers to a total length 232 of the scarf 222 beginning at a centerline 238 of the spray well 216 and ending where the scarf 222 becomes flush with the top surface 212. Additionally, the height 230 of the scarf 222 refers to a maximum height 230 of the scarf 222. For the embodiment depicted, the length 232 may generally be greater than about forty thousandths of an inch ("mils") and less than about three hundred mils. For example, in certain exemplary embodiments, the length 232 may generally be greater than about fifty mils and less than about two hundred and fifty mils, such as greater than about seventy-five mils and less than about two hundred mils. Additionally, the height 230 of the scarf 222 may generally be greater than about five mils and less than about fifty mils. For example, in certain exemplary embodiments, the height 230 of the scarf 222 may generally be greater than about ten mils and less than about forty mils, such as greater than about fifteen mils and less than about thirty mils.

As stated, for the embodiment depicted, the fuel post 202 is configured as an HP fuel post 202B, such that the scarf 222 is configured as an upstream scarf 222. Accordingly, in at least certain exemplary embodiments, the scarf 222 may define a length 232 to height 230 ratio between about one and a half (1.5) and about five, such as between about two and about four. However, in other exemplary embodiments, the fuel post 202 depicted may instead be configured as an LP fuel post 202A, such that the scarf 222 is configured as a downstream scarf 222. With such an exemplary embodiment, the scarf 222 may define a length 232 to height 230 ratio between about four and about nine, such as between about five and about eight. Accordingly, for certain exemplary fuel nozzles 100 the upstream scarf 222 may define a length 232 to height 230 ratio that is less than a length 232 to height 230 ratio of the downstream scarf 222 (such as at least about twenty percent less, such as at least about thirty percent less, such as at least about forty percent less, such as at least about fifty percent less).

Notably, in other exemplary embodiments, one or more of the LP fuel posts 202A and/or HP fuel posts 202B may define any other suitable scarf 222 in the respective top surfaces 212. For example, referring now to FIGS. 9 and 10, an HP fuel post 202B in accordance with another exemplary embodiment of the present disclosure is provided. The HP fuel post 202B depicted in FIGS. 9 and 10 may be configured in substantially the same manner as one or more of the exemplary HP fuel posts 202B described above. For example, the exemplary HP fuel post 202B depicted defines a top surface 212 and a spray well 216, the top surface 212 in turn defining a teardrop shape including a narrow end 218 and a wide end 220. Additionally, the exemplary HP fuel post 202B defines a scarf 222 in the top surface 212 extending from the spray well 216 in a second direction 228.

Figure 9:
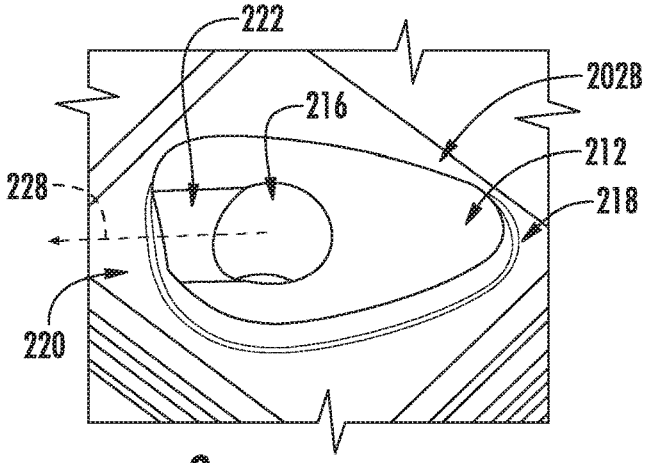
FIG. 9 is a perspective view of a fuel post of a fuel nozzle in accordance with another exemplary embodiment of the present disclosure.
Figure 10:
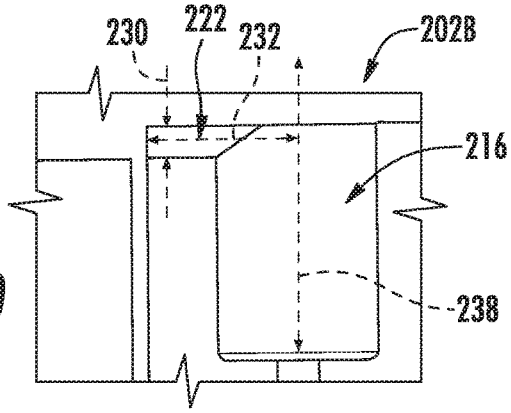
FIG. 10 is a side, cross-sectional view of the exemplary fuel post of FIG. 9.

However, for the exemplary HP fuel post 202B depicted in FIGS. 9 and 10, the narrow end 218 of the top surface 212 is instead positioned downstream of the wide end 220 of the top surface 212 along the second direction 228 (i.e., oriented in the same manner as the LP fuel post 202A depicted, e.g., in FIGS. 4 and 5). Accordingly, the fuel post 202B does not have the real estate to have a gradual scarf 222, such as one or more of the scarfs 222 previously depicted. The exemplary scarf 222 of the HP fuel post 202B depicted is instead configured as a channel defining a height 230 and a length 232. For the embodiment depicted, the height 230 is substantially constant along the length 232. In certain exemplary embodiments, the height 230 of the scarf 222 may generally be greater than about five mils and less than about fifty mils.

Notably, however, in other embodiments, the scarf 222 may have any other suitable shape extending through an outer edge of the fuel post 202 (e.g., non-uniform height 230 and/or width). Additionally, in other exemplary embodiments, one or more of the exemplary scarfs 222 extending to a narrow end 218 of the fuel post 202 may still extend through an outer edge of the fuel post 202 (e.g., in the same manner the scarf 222 configured as a channel does in FIGS. 9 and 10).

Additionally, referring now generally to FIGS. 11 through 18, various other embodiments of an HP fuel post 202B and scarf 222 are provided, along with exemplary tools for forming such scarfs 222. The HP fuel posts 202B and scarfs 222 depicted in FIGS. 11 through 18 may be configured in substantially the same manner as one or more of the exemplary HP fuel posts 202B described above. Additionally, one or more of the LP fuel posts 202A may have a similar configuration.

Figure 11:
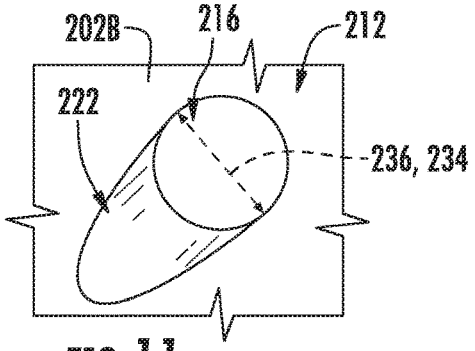
FIG. 11 is a top view of a fuel post in accordance with yet another exemplary embodiment of the present disclosure.
Figure 12:
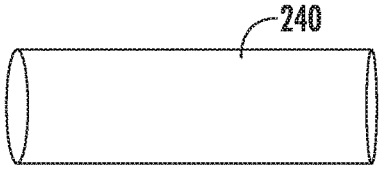
FIG. 12 is a side view of a formation tool for forming a scarf in the exemplary fuel post of FIG. 11 in accordance with an exemplary embodiment of the present disclosure.

Referring first to FIGS. 11 and 12, the exemplary scarf 222 is a cylindrical scarf 222, formed using a cylindrical forming tool 240. The forming tool 240 may be a drill bit, or any other suitable tool for removing material from the fuel post 202. For example, in other embodiments, the forming tool 240 may be a virtual tool for defining these shapes in a solid model for use with additive or other advanced manufacturing methods. With such an exemplary embodiment, a maximum width 236 of the scarf 222 may be substantially equal to a maximum width 234 of the spray well 216 of the fuel post 202. Additionally, the scarf 222 may define a substantially straight slope from a point defining its maximum height to a point defining its minimum height.

Figure 13:
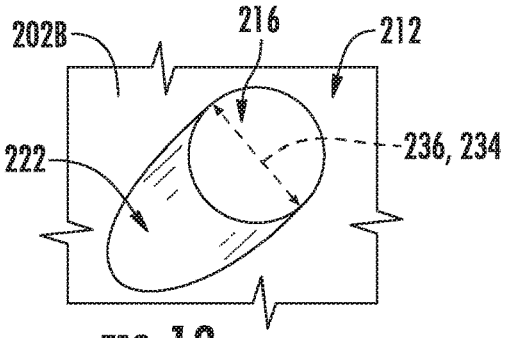
FIG. 13 is a top view a fuel post in accordance with still another exemplary embodiment of the present disclosure.
Figure 14:
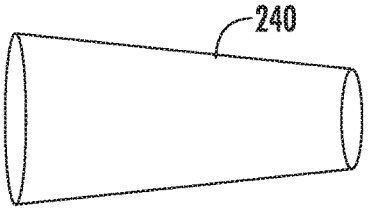
FIG. 14 is a side view of a formation tool for forming a scarf in the exemplary fuel post of FIG. 13 in accordance with an exemplary embodiment of the present disclosure.
Figure 15:
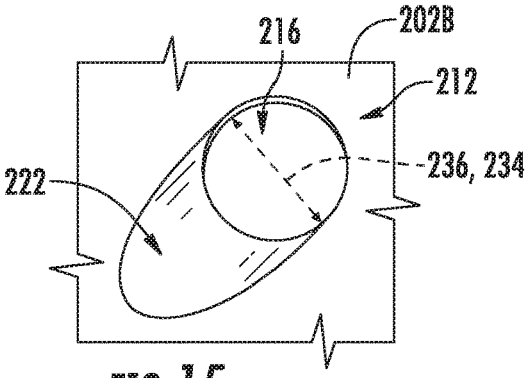
FIG. 15 is a top view a fuel post in accordance with yet another exemplary embodiment of the present disclosure.
Figure 16:
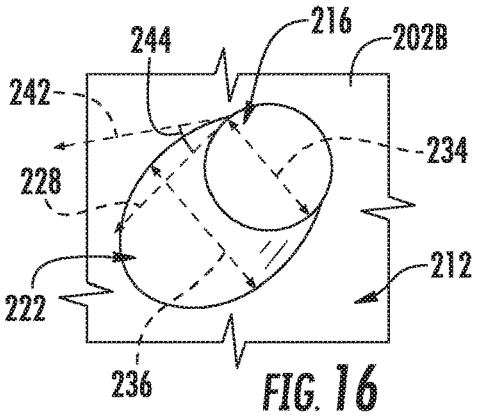
FIG. 16 is a top view a fuel post in accordance with still another exemplary embodiment of the present disclosure.
Figure 17:
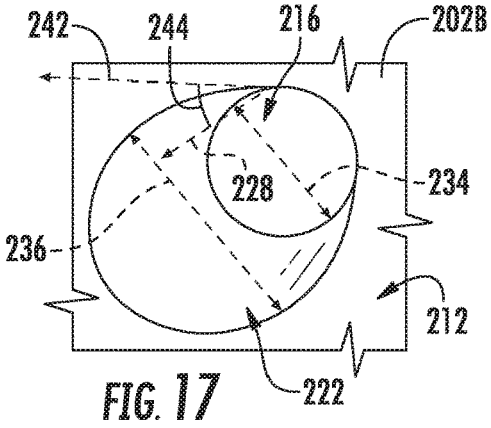
FIG. 17 is a top view a fuel post in accordance with yet another exemplary embodiment of the present disclosure.

Referring to FIGS. 13 and 14, the exemplary scarf 222 is formed using a frustoconical forming tool 240. With such an exemplary embodiment, a width 236 of the scarf 222 at its shallow end may be wider than when formed of a cylindrical forming tool 240, such as the exemplary cylindrical forming tool 240 of FIG. 12.

Figure 18:
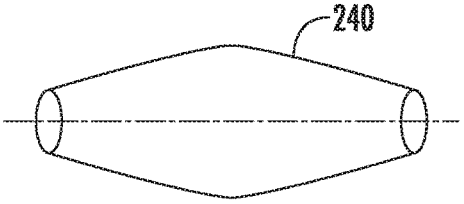
FIG. 18 is a side view of a formation tool for forming a scarf in one or more of the exemplary fuel posts of FIGS. 15 through 17 in accordance with an exemplary embodiment of the present disclosure.

Referring now to FIGS. 15 through 18, three exemplary scarfs 222 are provided (FIGS. 15 through 17) formed using an ellipsoid forming tool 240 (FIG. 18). With such exemplary embodiments, varying a size of the ellipsoid forming tool 240 allows for modification of a maximum width 236 of the scarf 222. For example, in the embodiment of FIG. 15, the maximum width 236 of the scarf 222 is substantially equal to the maximum width 234 of the spray well 216. By contrast, for the exemplary embodiments of FIGS. 16 and 17, the scarfs 222 each define a maximum width 236 greater than the maximum width 234 of the spray well 216. Moreover, the exemplary embodiments of FIGS. 16 and 17 additionally define a tangent line 242 at the spray well 216. For the embodiment depicted, the tangent line 242 of the scarfs 222 of FIGS. 16 and 17 each define an angle 244 with the second direction 228 greater than zero degrees. For example, the tangent line 242 of the exemplary scarf 222 of FIG. 16 may define an angle 244 of at least about fifteen degrees with the second direction 228, and the tangent line 242 of the exemplary scarf 222 of FIG. 17 may define an angle 244 of at least about thirty degrees with the second direction 228, such as an angle 244 of at least about forty-five degrees with the second direction 228.

Furthermore, in still other exemplary embodiments, one or more of the LP fuel posts 202A and/or HP fuel posts 202B may have any other suitable configuration, and may define any other suitable scarf 222. For example, referring now to FIGS. 19 and 20, an HP fuel post 202B in accordance with another exemplary embodiment of the present disclosure is provided. The HP fuel post 202B depicted in FIGS. 19 and 20 may be configured in substantially the same manner as one or more of the exemplary HP fuel posts 202B described above. For example, the exemplary HP fuel post 202B depicted defines a top surface 212 and a main fuel orifice 166, the top surface 212 in turn defining a teardrop shape including a narrow end 218 and a wide end 220. The narrow end 218 of the top surface 212 is positioned upstream of the wide end 220 of the top surface 212 along a second direction 228. Additionally, the exemplary HP fuel post 202B defines a scarf 222 in the top surface 212 extending away from the main fuel orifice 166 in the second direction 228.

Figure 19:
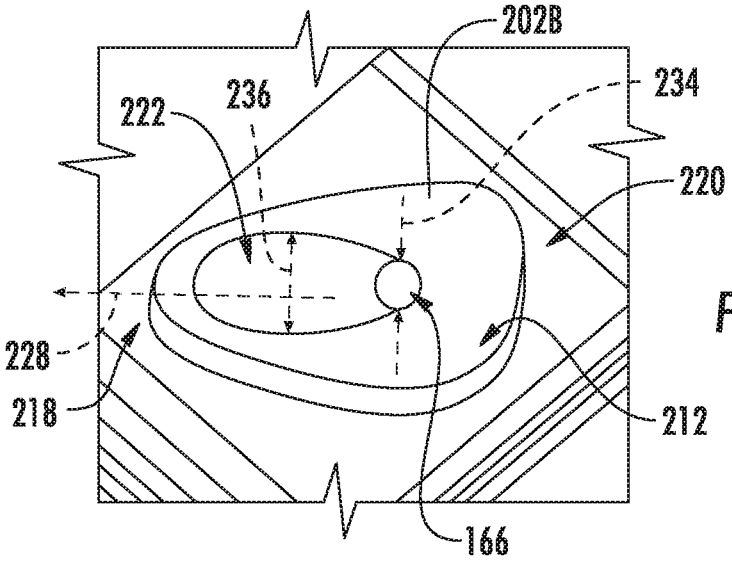
FIG. 19 is a perspective view of a fuel post of a fuel nozzle in accordance with an exemplary embodiment of the present disclosure.
Figure 20:
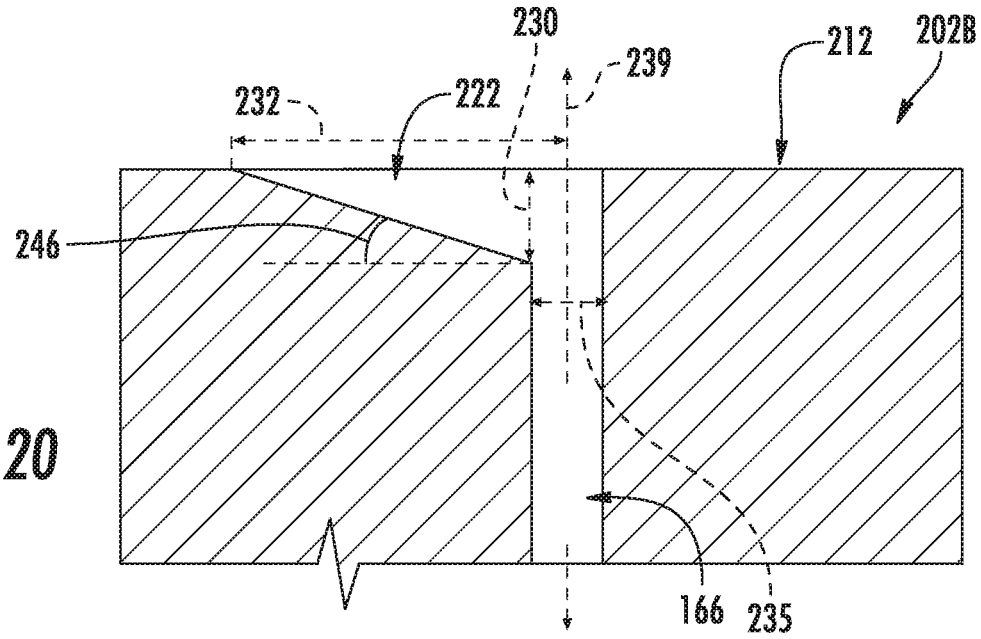
FIG. 20 is a side, cross-sectional view of the exemplary fuel post of FIG. 7.

However, for the exemplary HP fuel post 202B depicted in FIGS. 19 and 20, the HP fuel post 202B does not define a spray well (see, e.g., spray well 216 depicted in the embodiments above), and instead, the main fuel orifice 166 extends all the way up to the top surface 212 of the HP fuel post 202B. Accordingly, for the embodiment depicted, the scarf 222 of the HP fuel post 202B extends in the top surface 212 from the main fuel orifice 166 of the HP fuel post 202B. Additionally, with such an embodiment, a length 232 of the scarf 222 refers to a total length of the scarf 222 beginning at a centerline 239 of the main fuel orifice 166 and ending where the scarf 222 becomes flush with the top surface 212.

Furthermore, it will be appreciated that the main fuel orifice 166 of the HP fuel post 202B defines a maximum width 235. For the embodiment depicted, the maximum width 235 is substantially constant along a length of the main fuel orifice 166, or rather along a centerline 239 of the main fuel orifice 166.

Notably, for the embodiment depicted in FIGS. 19 and 20, the scarf 222 of the HP fuel post 202B includes a bottom wall defining an angle 246. The angle 246 is defined relative to a plane parallel to the top surface 212 of the HP fuel post 202B. The angle 246 may be between about minus 45 degrees (−45°) and 45 degrees. For example, the angle 246 may be between about zero degrees and about 45 degrees.

Additionally, although an HP fuel post 202B is depicted in FIGS. 19 and 20, in other exemplary embodiments, one or more of the LP fuel posts 202A may be configured in substantially the same manner. Moreover, in other embodiments, aspects of the HP fuel post 202B depicted in FIGS. 19 and 20 may be combined with aspects of the HP fuel posts 202B described above in, e.g., FIGS. 2 through 18.

Furthermore, referring now to FIGS. 21 through 24, additional exemplary embodiments of an HP fuel post 202B are provided. Each of FIGS. 21 through 24 provide a top end view of an exemplary HP fuel post 202B. However, although the each of the embodiments are described as an HP fuel post 202B, in other embodiments, aspects from the exemplary fuel posts depicted in FIGS. 21 through 24 may additionally, or alternatively, be incorporated into an LP fuel post 202A.

Figure 21:
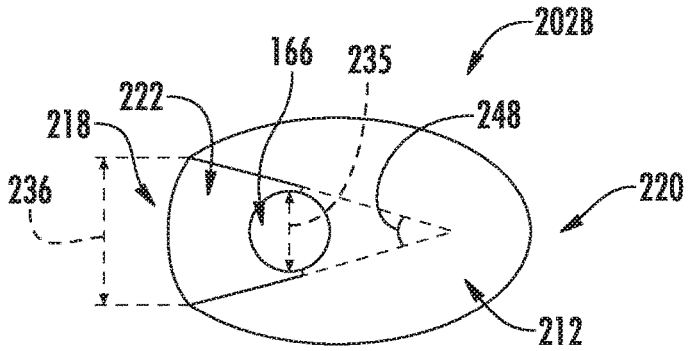
FIG. 21 is a top view a fuel post in accordance with another exemplary embodiment of the present disclosure.
Figure 22:
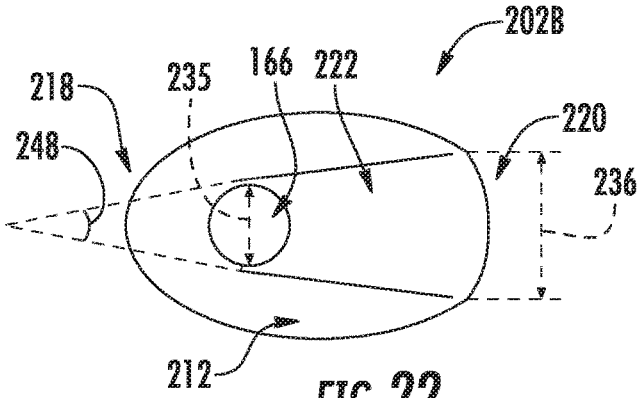
FIG. 22 is a top view a fuel post in accordance with still another exemplary embodiment of the present disclosure.

Each of the exemplary HP fuel posts 202B depicted in FIGS. 21 through 24 generally define a main fuel orifice 166, a top surface 212, and a scarf 222. With reference to FIGS. 21 and 22, the scarfs 222 each define a maximum width 236, and similarly, the main fuel orifice 166 defines a maximum width 235 (i.e., a maximum diameter, given that the exemplary main fuel orifice 166 depicted is cylindrical). For the embodiments depicted, the maximum width 236 of the scarfs 222 are each greater than the respective maximum width 235 of the main fuel orifices 166. For example, in certain embodiments, the maximum width 236 may be at least about two times as large as the maximum width 235 of the main fuel orifice 166, such as at least about five times as large, such as up to about ten times as large as the maximum width 235 of the main fuel orifice 166. Additionally, for the embodiments of FIGS. 21 and 22, the scarfs 222 each further define a scarf width angle 248. The scarf width angle 248 may be greater than or equal to zero degrees and less than 360°. For example, in certain exemplary embodiments, the scarf width angle 248 may be greater than zero degrees and less than about 180°, such as greater than zero degrees and less than about 100°.

Notably, for the embodiment of FIG. 21, the scarf 222 extends from the main fuel orifice 166 towards the narrow end 218 of the HP fuel post 202B. By contrast, for the embodiment FIG. 22, the scarf 222 extends from the main fuel orifice 166 towards the wide end 220 of the HP fuel post 202B.

Figure 23:
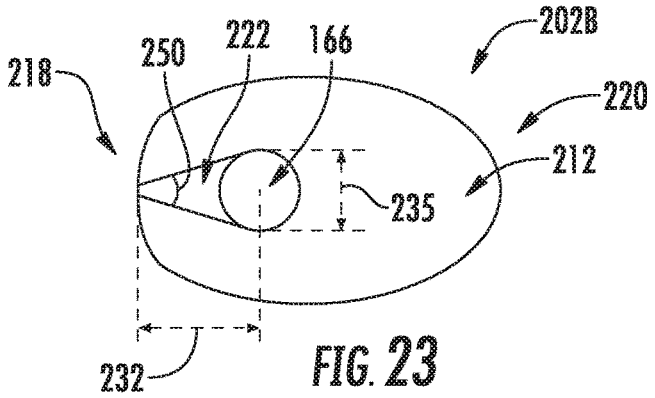
FIG. 23 is a top view a fuel post in accordance with yet another exemplary embodiment of the present disclosure.
Figure 24:
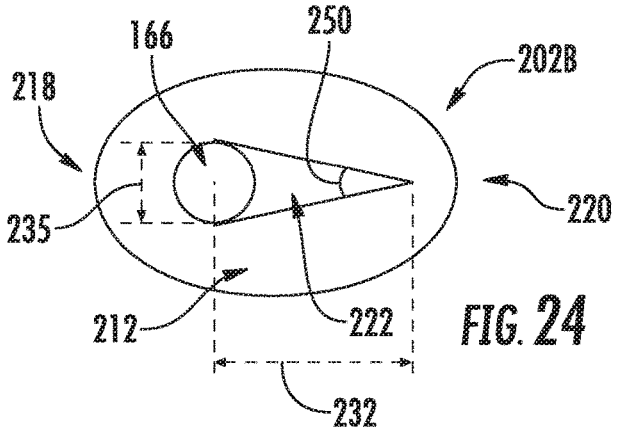
FIG. 24 is a top view a fuel post in accordance with still another exemplary embodiment of the present disclosure.

Referring now to the exemplary embodiments of FIGS. 23 and 24, the scarfs 222 are each configured as a converging scarfs, as compared to the diverging scarfs depicted in FIGS. 21 and 22. More particularly, the exemplary scarfs 222 of FIGS. 23 and 24 each define a scarf taper angle 250. The scarf taper angle 250 may be greater than zero degrees and less than 180°. For example, in certain exemplary embodiments, the scarf taper angle may be greater than 15° and less than about 150°, such as less than about 100°, such as less than about 90°. The exemplary scarfs 222 of FIGS. 23 and 24 each also define a length 232. The length 232 of the exemplary scarfs 222 of FIGS. 23 and 24 may be greater than or equal to a width 235 of the main fuel orifice 166, and less than about ten times the width 235 of the main fuel orifice 166. For example, in certain exemplary embodiments, the length 232 of the exemplary scarfs 222 of FIGS. 23 and 24 may be greater than or equal to the width 235 of the main fuel orifice 166, and less than about five times the width 235 of the main fuel orifice 166.

As will be appreciated, inclusion of a fuel nozzle including a main injection ring having one or more fuel posts extending into or through respective openings in an outer body of the fuel nozzle with upstream scarfs, in combination with one or more fuel posts extending into or through respective openings in the outer body of the fuel nozzle with downstream scarfs, may provide for a greater pressure differential to provide the desired fuel purging. Such a configuration may therefore result in less fuel coking, and therefore may increase a useful life of the fuel nozzle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fuel nozzle for a gas turbine engine, the fuel nozzle defining a centerline axis and comprising:

an outer body extending generally along the centerline axis and defining an exterior surface, the outer body defining a plurality of openings in the exterior surface; and a main injection ring disposed at least partially inside the outer body, the main injection ring including a plurality of fuel posts extending into or through the plurality of openings of the outer body, the plurality of fuel posts comprising:

an LP fuel post defining a first main fuel orifice, a first top surface, and a first scarf, the first scarf of the LP fuel post extending in the first top surface in a first direction relative to the centerline axis away from the first main fuel orifice; and an HP fuel post defining a second main fuel orifice, a second top surface, and a second scarf, the second scarf of the HP fuel post extending in the second top surface in a second direction relative to the centerline axis away from the second main fuel orifice, the second direction being at least ninety degrees different than the first direction;

wherein the first scarf defined by the LP fuel post defines a first height, a first length, or both that is different than a second height, a second length, or both of the second scarf defined by the HP fuel post.

2. The fuel nozzle of claim 1, wherein the LP fuel post further defines a first spray well between the first main fuel orifice and the first top surface, wherein the first scarf of the LP fuel post extends in the first top surface from the first spray well of the LP fuel post, wherein the HP fuel post also further defines a second spray well between the second main fuel orifice and the second top surface, and wherein the second scarf of the HP fuel post also extends in the second top surface from the second spray well of the HP fuel post.

3. The fuel nozzle of claim 1, wherein the first scarf of the LP fuel post extends in the first top surface from the first main fuel orifice of the LP fuel post, and wherein the second scarf of the HP fuel post also extends in the second top surface from the second main fuel orifice of the HP fuel post.

4. The fuel nozzle of claim 1, wherein the second direction is about one hundred and eighty degrees different than the first direction.

5. The fuel nozzle of claim 1, wherein the LP fuel post is arranged sequentially with the HP fuel post.

6. The fuel nozzle of claim 1, wherein the LP fuel post comprises a plurality of LP fuel posts and the HP fuel post comprises a plurality of HP fuel posts.

7. The fuel nozzle of claim 6, wherein the plurality of LP fuel posts are arranged with the plurality of HP fuel posts in a sequential and alternating manner.

8. The fuel nozzle of claim 6, wherein the plurality of LP fuel posts are grouped together and wherein the plurality of HP fuel posts are also grouped together.

9. The fuel nozzle of claim 1, wherein the second scarf defined in the top surface of the HP fuel post is a channel defining a third height and a third length, and wherein the third height is substantially constant along the third length.

10. The fuel nozzle of claim 1, wherein the first top surface and the second top surface each generally define at least one of a teardrop shape, an ovular shape, or a circular shape.

11. The fuel nozzle of claim 1, wherein the second top surface of the HP fuel post includes a narrow end and a wide end, and wherein the narrow end is positioned forward of the wide end along the second direction.

12. The fuel nozzle of claim 1, wherein the outer body further defines an airflow direction over the outer body relative to the centerline axis, and wherein the first direction is substantially aligned with the airflow direction defined by the outer body.

13. The fuel nozzle of claim 1, wherein the main injection ring comprises a main fuel gallery extending generally about an axial centerline and fluidly connecting the plurality of fuel posts.

14. The fuel nozzle of claim 1, further comprising:

a suspension structure connecting the main injection ring to the outer body, the suspension structure configured to permit deflection of the main injection ring relative to an axial centerline.

15. The fuel nozzle of claim 1, wherein the first scarf defined by the LP fuel post defines a first ratio of the first length to the first height, wherein the second scarf defined by the HP fuel post similarly defines a second ratio of the second length to the second height, and wherein the second ratio of the second scarf defined by the HP fuel post is less than the first ratio of the first scarf defined by the LP fuel post.

16. The fuel nozzle of claim 15, wherein the second ratio of the second scarf defined by the HP fuel post is at least about twenty percent less than the first ratio of the first scarf defined by the LP fuel post.

* * * * *